US010709196B2

(12) United States Patent
Amos et al.

(10) Patent No.: US 10,709,196 B2
(45) Date of Patent: Jul. 14, 2020

(54) GROUND-ENGAGING STRUCTURES FOR ARTICLE FOOT FOOTWEAR

(71) Applicant: NIKE, Inc., Beaverton, OR (US)

(72) Inventors: Michael S. Amos, Beaverton, OR (US); Karen S. Dimoff, Portland, OR (US); Lysandre Follet, Portland, OR (US); Thomas Foxen, Portland, OR (US); John Hurd, Lake Oswego, OR (US); Shane S. Kohatsu, Portland, OR (US); Troy C. Lindner, Portland, OR (US); David J. Roulo, Portland, OR (US); Adam Thuss, Portland, OR (US); Andrea Vinet, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 273 days.

(21) Appl. No.: 15/576,011

(22) PCT Filed: May 20, 2016

(86) PCT No.: PCT/US2016/033526
§ 371 (c)(1),
(2) Date: Nov. 21, 2017

(87) PCT Pub. No.: WO2016/191279
PCT Pub. Date: Dec. 1, 2016

(65) Prior Publication Data

US 2018/0153264 A1 Jun. 7, 2018

Related U.S. Application Data

(60) Provisional application No. 62/165,565, filed on May 22, 2015.

(51) Int. Cl.
*A43B 13/12* (2006.01)
*A43B 1/00* (2006.01)
(Continued)

(52) U.S. Cl.
CPC ..... *A43B 13/122* (2013.01); *A43B 1/0009* (2013.01); *A43B 3/0063* (2013.01);
(Continued)

(58) Field of Classification Search
CPC ..... A43B 13/141; A43B 13/223; A43B 13/26; A43B 5/001; A43B 5/02; A43B 5/06;
(Continued)

(56) References Cited

U.S. PATENT DOCUMENTS 3,898,751 A 8/1975 Gustin
4,012,855 A * 3/1977 Gardner ..... A43B 1/0009 36/29

(Continued)

FOREIGN PATENT DOCUMENTS

FR 520232 A * 6/1921 ..... A43B 13/20
FR 665591 A 9/1929

(Continued)

OTHER PUBLICATIONS

Aug. 10, 2016—International Search Report—PCTUS2016/033526.

*Primary Examiner* — Megan E Lynch
(74) *Attorney, Agent, or Firm* — Banner & Witcoff, Ltd.

(57) ABSTRACT

Ground-engaging components for articles of footwear include: (a) an outer perimeter boundary rim that at least partially defines an outer perimeter of the ground-engaging component; (b) an inner perimeter boundary rim that at least partially defines an inner perimeter of the ground-engaging component, wherein a first open space is defined between the outer perimeter boundary rim and the inner perimeter boundary rim, and wherein a second open space is defined between a lateral side portion of the inner perimeter boundary rim and a medial side portion of the inner perimeter boundary rim; and (c) a support structure extending from the
(Continued)

outer perimeter boundary rim to the inner perimeter boundary rim and across the first open space.

20 Claims, 9 Drawing Sheets

(51) Int. Cl.
*A43B 3/00* (2006.01)
*A43B 5/06* (2006.01)
*A43B 13/22* (2006.01)
*A43C 15/16* (2006.01)

(52) U.S. Cl.
CPC ..... *A43B 5/06* (2013.01); *A43B 13/223* (2013.01); *A43C 15/165* (2013.01)

(58) Field of Classification Search
CPC ..... A43B 1/009; A43C 15/16; A43C 15/162; A43C 15/165; A43C 15/167
See application file for complete search history.

(56) References Cited

U.S. PATENT DOCUMENTS 4,782,604 A * 11/1988 Wen-Shown ..... A43B 5/001 36/127
5,353,526 A * 10/1994 Foley ..... A43B 1/0009 36/35 R
6,006,454 A 12/1999 Sitzler, Sr.
6,029,377 A 2/2000 Niikura et al.
6,381,878 B1 5/2002 Kennedy, III et al.
6,564,476 B1 * 5/2003 Hernandez ..... A43B 1/0009 36/103
6,793,996 B1 9/2004 Umezawa
9,271,540 B1 3/2016 MacNeill et al.
2002/0062578 A1 * 5/2002 Lussier ..... A43B 5/02 36/59 R
2002/0144438 A1 10/2002 Better
2005/0193592 A1 * 9/2005 Dua ..... A43B 1/04 36/45
2007/0266593 A1 * 11/2007 Schindler ..... A43B 1/0009 36/28
2009/0100716 A1 * 4/2009 Gerber ..... A43B 5/02 36/114
2009/0126230 A1 * 5/2009 McDonald ..... A43B 1/0063 36/88
2009/0211118 A1 8/2009 Krikorian et al.
2011/0192056 A1 * 8/2011 Geser ..... A43B 13/26 36/114
2012/0036740 A1 * 2/2012 Gerber ..... A43B 5/02 36/134
2012/0180343 A1 * 7/2012 Auger ..... A43B 5/02 36/30 R
2013/0047465 A1 * 2/2013 Auger ..... A43B 13/223 36/66
2013/0055596 A1 * 3/2013 Wan ..... A43B 13/141 36/25 R
2013/0055599 A1 * 3/2013 Peikert ..... A43B 7/125 36/30 R
2013/0067773 A1 * 3/2013 Auger ..... A43B 5/02 36/103
2013/0118036 A1 * 5/2013 Gibson ..... A43B 1/0009 36/103
2013/0125416 A1 * 5/2013 Hoffer ..... A43B 1/0009 36/83
2013/0139412 A1 * 6/2013 Auger ..... A43B 1/0009 36/25 R
2013/0326908 A1 12/2013 Grott et al.
2014/0013625 A1 1/2014 Grott et al.
2014/0026441 A1 1/2014 Stauffer
2014/0026443 A1 * 1/2014 Derrier ..... A43B 13/14 36/107
2014/0026444 A1 * 1/2014 Howley ..... A43B 13/14 36/134
2014/0202042 A1 * 7/2014 Berend ..... A43B 13/141 36/25 R
2014/0215853 A1 * 8/2014 Rushbrook ..... A43B 5/001 36/102
2014/0215862 A1 * 8/2014 Curl ..... A43C 1/00 36/59 R
2015/0128452 A1 * 5/2015 Hull ..... A43B 13/14 36/103
2015/0128455 A1 * 5/2015 Lubart ..... A43B 13/22 36/25 R
2016/0120265 A1 5/2016 Cavaliere et al.

FOREIGN PATENT DOCUMENTS

FR 2119293 A5 * 8/1972 ..... A43B 1/0009
FR 2183411 A5 * 12/1973 ..... A43B 1/0009
FR 2220128 A5 9/1974
GB 1438009 A 6/1976
JP 2002306207 A 10/2002
JP 2005304653 A 11/2005
WO 9103182 A1 3/1991
WO WO-9103182 A1 * 3/1991 ..... A43C 15/165
WO WO-2012007093 A1 * 1/2012 ..... A43B 13/143

* cited by examiner

GROUND-ENGAGING STRUCTURES FOR ARTICLE FOOT FOOTWEAR

CROSS-REFERENCE TO RELATED APPLICATION

This application is a U.S. National Stage application under 35 U.S.C. § 371 of International Application PCT/US2016/033526, filed May 20, 2016, which claims priority to U.S. Provisional Patent Application No. 62/165,565, titled "Ground-Engaging Structures for Articles of Footwear" and filed May 22, 2015. These applications in their entirety, are incorporated by reference herein.

FIELD OF THE INVENTION

The present invention relates to the field of footwear. More specifically, aspects of the present invention pertain to articles of athletic footwear and/or ground-engaging structures for articles of footwear, e.g., used in track and field events and/or long distance running events (e.g., for 3K, 5K, 10K, half marathons, marathons, etc.).

TERMINOLOGY/GENERAL INFORMATION

First, some general terminology and information is provided that will assist in understanding various portions of this specification and the invention(s) as described herein. As noted above, the present invention relates to the field of footwear. "Footwear" means any type of wearing apparel for the feet, and this term includes, but is not limited to: all types of shoes, boots, sneakers, sandals, thongs, flip-flops, mules, scuffs, slippers, sport-specific shoes (such as track shoes, golf shoes, tennis shoes, baseball cleats, soccer or football cleats, ski boots, basketball shoes, cross training shoes, etc.), and the like.

FIG. 1 also provides information that may be useful for explaining and understanding the specification and/or aspects of this invention. More specifically, FIG. 1 provides a representation of a footwear component 100, which in this illustrated example constitutes a portion of a sole structure for an article of footwear. The same general definitions and terminology described below may apply to footwear in general and/or to other footwear components or portions thereof, such as an upper, a midsole component, an outsole component, a ground-engaging component, etc.

First, as illustrated in FIG. 1, the terms "forward" or "forward direction" as used herein, unless otherwise noted or clear from the context, mean toward or in a direction toward a forward-most toe ("FT") area of the footwear structure or component 100. The terms "rearward" or "rearward direction" as used herein, unless otherwise noted or clear from the context, mean toward or in a direction toward a rear-most heel area ("RH") of the footwear structure or component 100. The terms "lateral" or "lateral side" as used herein, unless otherwise noted or clear from the context, mean the outside or "little toe" side of the footwear structure or component 100. The terms "medial" or "medial side" as used herein, unless otherwise noted or clear from the context, mean the inside or "big toe" side of the footwear structure or component 100.

Also, various example features and aspects of this invention may be disclosed or explained herein with reference to a "longitudinal direction" and/or with respect to a "longitudinal length" of a footwear component 100 (such as a footwear sole structure). As shown in FIG. 1, the "longitudinal direction" is determined as the direction of a line extending from a rearmost heel location (RH in FIG. 1) to the forwardmost toe location (FT in FIG. 1) of the footwear component 100 in question (a sole structure or foot-supporting member in this illustrated example). The "longitudinal length" L is the length dimension measured from the rearmost heel location RH to the forwardmost toe location FT. The rearmost heel location RH and the forwardmost toe location FT may be located by determining the rear heel and forward toe tangent points with respect to front and back parallel vertical planes VP when the component 100 (e.g., sole structure or foot-supporting member in this illustrated example, optionally as part of an article of footwear or foot-receiving device) is oriented on a horizontal support surface S in an unloaded condition (e.g., with no weight or force applied to it other than potentially the weight/force of the shoe components with which it is engaged). If the forwardmost and/or rearmost locations of a specific footwear component 100 constitute a line segment (rather than a tangent point), then the forwardmost toe location and/or the rearmost heel location constitute the mid-point of the corresponding line segment. If the forwardmost and/or rearmost locations of a specific footwear component 100 constitute two or more separated points or line segments, then the forwardmost toe location and/or the rearmost heel location constitute the mid-point of a line segment connecting the furthest spaced and separated points and/or furthest spaced and separated end points of the line segments (irrespective of whether the midpoint itself lies on the component 100 structure). If the forwardmost and/or rearwardmost locations constitute one or more areas, then the forwardmost toe location and/or the rearwardmost heel location constitute the geographic center of the area or combined areas (irrespective of whether the geographic center itself lies on the component 100 structure).

Once the longitudinal direction of a component or structure 100 has been determined with the component 100 oriented on a horizontal support surface S in an unloaded condition, planes may be oriented perpendicular to this longitudinal direction (e.g., planes running into and out of the page of FIG. 1). The locations of these perpendicular planes may be specified based on their positions along the longitudinal length L where the perpendicular plane intersects the longitudinal direction between the rearmost heel location RH and the forwardmost toe location FT. In this illustrated example of FIG. 1, the rearmost heel location RH is considered as the origin for measurements (or the "0L position") and the forwardmost toe location FT is considered the end of the longitudinal length of this component (or the "1.0L position"). Plane position may be specified based on its location along the longitudinal length L (between 0L and 1.0L), measured forward from the rearmost heel RH location in this example. FIG. 1 shows locations of various planes perpendicular to the longitudinal direction (and oriented in the transverse direction) and located along the longitudinal length L at positions 0.25L, 0.4L, 0.5L, 0.55L, 0.6L, and 0.8L (measured in a forward direction from the rearmost heel location RH). These planes may extend into and out of the page of the paper from the view shown in FIG. 1, and similar planes may be oriented at any other desired positions along the longitudinal length L. While these planes may be parallel to the parallel vertical planes VP used to determine the rearmost heel RH and forwardmost toe FT locations, this is not a requirement. Rather, the orientations of the perpendicular planes along the longitudinal length L will depend on the orientation of the longitudinal direction, which may or may not be parallel to the horizontal surface S in the arrangement/orientation shown in FIG. 1.

SUMMARY

This Summary is provided to introduce some concepts relating to this invention in a simplified form that are further described below in the Detailed Description. This Summary is not intended to identify key features or essential features of the invention.

While potentially useful for any desired types or styles of shoes, aspects of this invention may be of particular interest for athletic shoes, including track shoes or shoes for relatively long distance runs (e.g., for 3K, 5K, 10K, half marathons, marathons, etc.).

Some aspects of this invention relate to ground-engaging components for articles of footwear that include: (a) an outer perimeter boundary rim (e.g., at least 3 mm wide (0.12 inches)) that at least partially defines an outer perimeter of the ground-engaging component (the outer perimeter boundary rim may be present around at least 80% or at least 90% of the outer perimeter of the ground-engaging component); (b) an inner perimeter boundary rim (e.g., at least 3 mm wide (0.12 inches)) that at least partially defines an inner perimeter of the ground-engaging component (the inner perimeter boundary rim may be present around at least 80% or at least 90% of the inner perimeter of the ground-engaging component), wherein a first open space is defined between the outer perimeter boundary rim and the inner perimeter boundary rim, and wherein a second open space is defined between a lateral side portion of the inner perimeter boundary rim and a medial side portion of the inner perimeter boundary rim; and (c) a support structure extending from the outer perimeter boundary rim to the inner perimeter boundary rim and at least partially across the first open space.

The outer perimeter boundary rim and the inner perimeter boundary rim may be engaged together (e.g., joined by the support structure) as an unitary, one piece construction and/or may form a U-shaped component that includes at least a lateral side forefoot support area, a front forefoot support area, and a medial side forefoot support area. A first free end of the ground-engaging component may be located at a lateral side forefoot support area or a lateral side midfoot support area and/or a second free end of the ground-engaging component may be located at a medial side forefoot support area or a medial side midfoot support area. In at least some example structures, the second free end will be located closer to a front forefoot support area of the ground-engaging component and/or sole structure than is the first free end (the lateral side free end will extend further rearward than the medial side free end). The outer perimeter boundary rim, the inner perimeter boundary rim, and the support structure extending across the first open space may have a combined mass of less than 40 grams, and in some examples, a combined mass of less than 35 grams, less than 30 grams, less than 25 grams, less than 20 grams, less than 18 grams, or even less than 16 grams. The overall ground-engaging component also may have any of these weighting characteristics.

The outer perimeter boundary rim may be connected with the inner perimeter boundary rim: (a) at a first free end boundary rim located at a lateral side forefoot support area or a lateral side midfoot support area and/or (b) at a second free end boundary rim located at a medial side forefoot support area or a medial side midfoot support area. In at least some example structures, the second free end boundary rim (at the medial side) will be located closer to a front forefoot support area of the ground-engaging component and/or sole structure than is the first free end boundary rim (at the lateral side).

If desired, an outside edge of the outer perimeter boundary rim and an inside edge of the inner perimeter boundary rim may be separated from one another across the first open space by a direct distance of no more than 1.75 inches (44.5 mm) around at least 60% of the outer perimeter of the ground-engaging component. In other example structures, the outside edge of the outer perimeter boundary rim and the inside edge of the inner perimeter boundary rim may be separated from one another across the first open space by a direct distance of no more than 1.5 inches (38.1 mm) around at least 60% (and in some examples, around at least 80%, around at least 90%, or even around 100%) of the outer perimeter of the ground-engaging component.

In at least some example structures in accordance with aspects of this invention, the outer perimeter boundary rim and the inner perimeter boundary rim will define an upper-facing surface and a ground-facing surface opposite the upper-facing surface, and the support structure will include a matrix structure extending from the inner and/or outer perimeter boundary rims (e.g., from the ground-facing surface and/or the upper-facing surface) and across the first open space to define a cellular construction. This matrix structure may define at least one of: (a) one or more open cells located within the first open space or (b) one or more partially open cells located within the first open space.

Additionally or alternatively, if desired, the matrix structure may define one or more cleat support areas for engaging or supporting primary traction elements, such as track spikes or other cleat elements (e.g., permanently fixed cleats or track spikes, removable cleats or track spikes, integrally formed cleats or track spikes, etc.). The cleat support area(s) may be located: (a) within one of the outer perimeter boundary rim or the inner perimeter boundary rim, (b) at least partially within one or both of the outer perimeter boundary rim and/or the inner perimeter boundary rim, (c) within the first open space, and/or (d) extending from one or both of the outer perimeter boundary rim and/or the inner perimeter boundary rim and into and/or across the first open space. The matrix structure further may define a plurality of secondary traction elements at various locations, e.g., dispersed around one or more of any present cleat support areas; between open and/or partially open cells of the matrix structure; at the outer perimeter boundary rim and/or the inner perimeter boundary rim; etc.

While the primary traction elements may be provided at any desired locations on ground-engaging components in accordance with this invention, in some example structures the cleat support areas for primary traction elements will be provided at least as follows: a first cleat support area (and optionally with an associated primary traction element) at or near a lateral forefoot support area or a lateral midfoot support area of the ground-engaging component; a second cleat support area (and optionally with an associated primary traction element) at the lateral forefoot support area and forward of the first cleat support area; a third cleat support area (and optionally with an associated primary traction element) at or near a medial forefoot support area or a medial midfoot support area of the ground-engaging component; and a fourth cleat support area (and optionally with an associated primary traction element) at the medial side forefoot support area and forward of the third cleat support area. Although some ground-engaging components according to some aspects of this invention will include only these four cleat support areas (and associated primary traction elements), more or fewer cleat support areas (and primary traction elements associated therewith) may be provided, if desired.

Additional aspects of this invention relate to articles of footwear that include an upper and a sole structure engaged with the upper. The sole structure will include a ground-engaging component having any one or more of the features described above and/or any combinations of features described above. The upper may be made from any desired upper materials and/or upper constructions, including upper materials and/or upper constructions as are conventionally known and used in the footwear art (e.g., especially upper materials and/or constructions used in track shoes or shoes for relatively long distance runs (e.g., for 3K, 5K, 10K, half marathons, marathons, etc.)). As some more specific examples, at least a portion (or even all or substantially all) of the upper may include a woven textile component and/or a knitted textile component (and/or other lightweight constructions).

Articles of footwear in accordance with at least some examples of this invention further may include a midsole component between the ground-engaging component and a bottom of the upper. The midsole component may include any desired materials and/or structures, including materials and/or structures as are conventionally known and used in the footwear art (e.g., especially midsole materials and/or structures used in track shoes or shoes for relatively long distance runs (e.g., for 3K, 5K, 10K, half marathons, marathons, etc.)). As some more specific examples, the midsole component may include one or more of: one or more foam midsole elements (e.g., made from polyurethane foam, ethylvinylacetate foam, etc.), one or more fluid-filled bladders, one or more mechanical shock absorbing structures, etc.

If desired, in accordance with at least some examples of this invention, at least some portion(s) of a bottom surface of the midsole component and/or the upper may be exposed at an exterior of the sole structure. As some more specific examples, the bottom surface of the midsole component and/or the upper may be exposed: (a) in the second open space (e.g., in the midfoot and/or forefoot support areas between opposite sides of the inner perimeter boundary rim of the ground-engaging component); (b) in the first open space (e.g., in the forefoot support area between the outer perimeter boundary rim and the inner perimeter boundary rim, through open cells and/or partially open cells in any present matrix structure, etc.); (c) in the arch support area of the sole structure; and/or (d) in the heel support area of the sole structure. As one more specific example structure, the bottom surface of the midsole component in one example shoe construction is exposed at the exterior of the sole structure and extends from the second open space (e.g., an area within the second open space) to a rear heel support area of the sole structure.

Also, if desired, sole structures in accordance with at least some examples of this invention further may include a heel reinforcement component, e.g., located at least at a lateral, rear heel support area of the sole structure (e.g., at a location of a "heel strike" location during at least some steps cycles for some people). This heel reinforcement component may be located just at the lateral, rear heel support area of the sole structure, and optionally may terminate before reaching a medial heel side of the sole structure. If desired, the heel reinforcement component also may be formed as a matrix structure with a plurality of open cells and/or partially open cells and/or the heel reinforcement component may be formed to include ground-engaging traction elements (e.g., at various locations in the heel reinforcement component matrix structure around cells of this matrix structure).

Additional aspects of this invention relate to methods of making ground-engaging support components, sole structures, and/or articles of footwear of the various types and structures described above.

BRIEF DESCRIPTION OF THE DRAWINGS

The foregoing Summary, as well as the following Detailed Description, will be better understood when read in conjunction with the accompanying drawings in which like reference numerals refer to the same or similar elements in all of the various views in which that reference number appears.

The reader should understand that the attached drawings are not necessarily drawn to scale.

DETAILED DESCRIPTION

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention.

Figure 1:
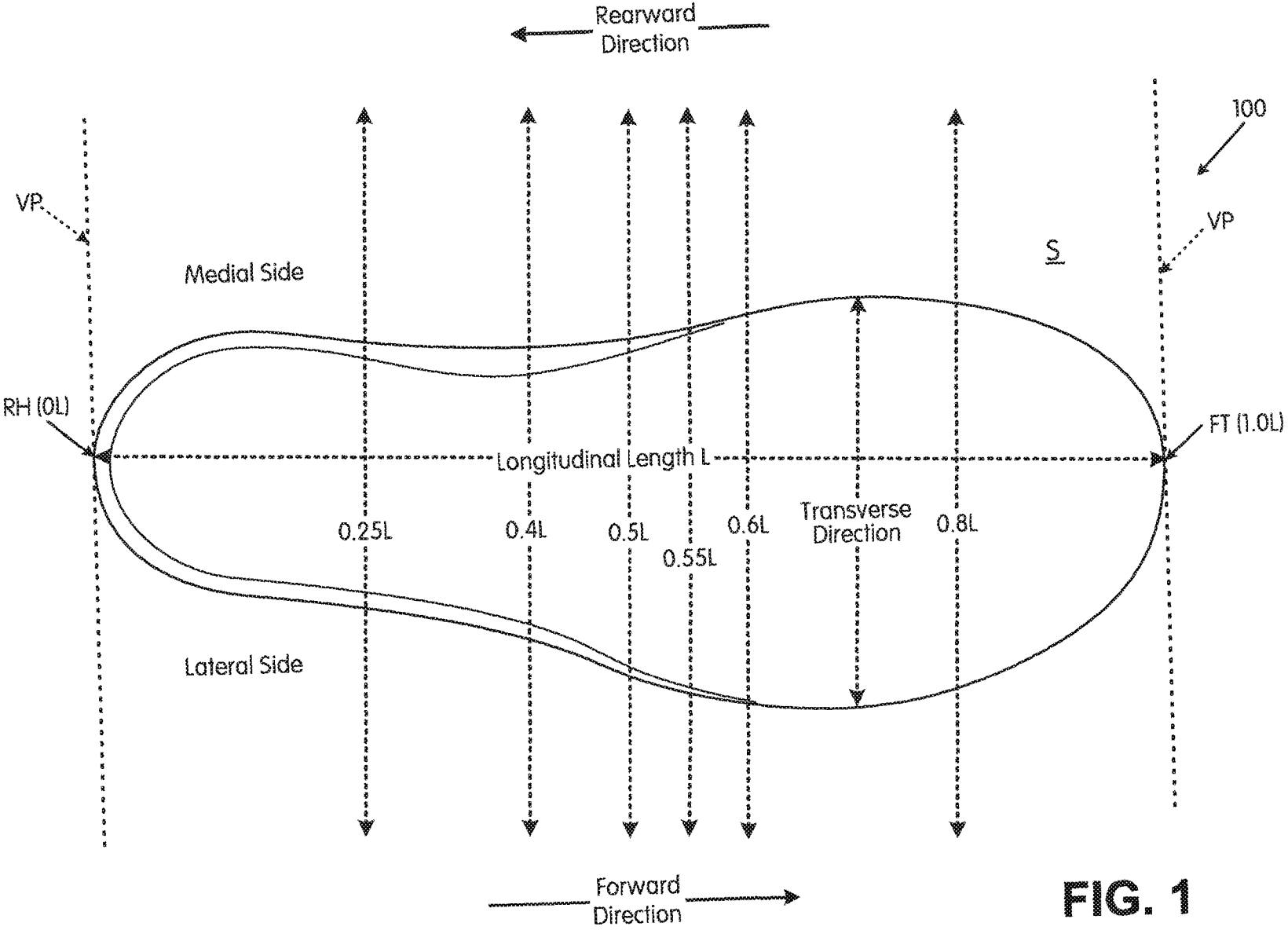
FIG. 1 is provided to help illustrate and explain background and definitional information useful for understanding certain terminology and aspects of this invention.
Figure 2A:
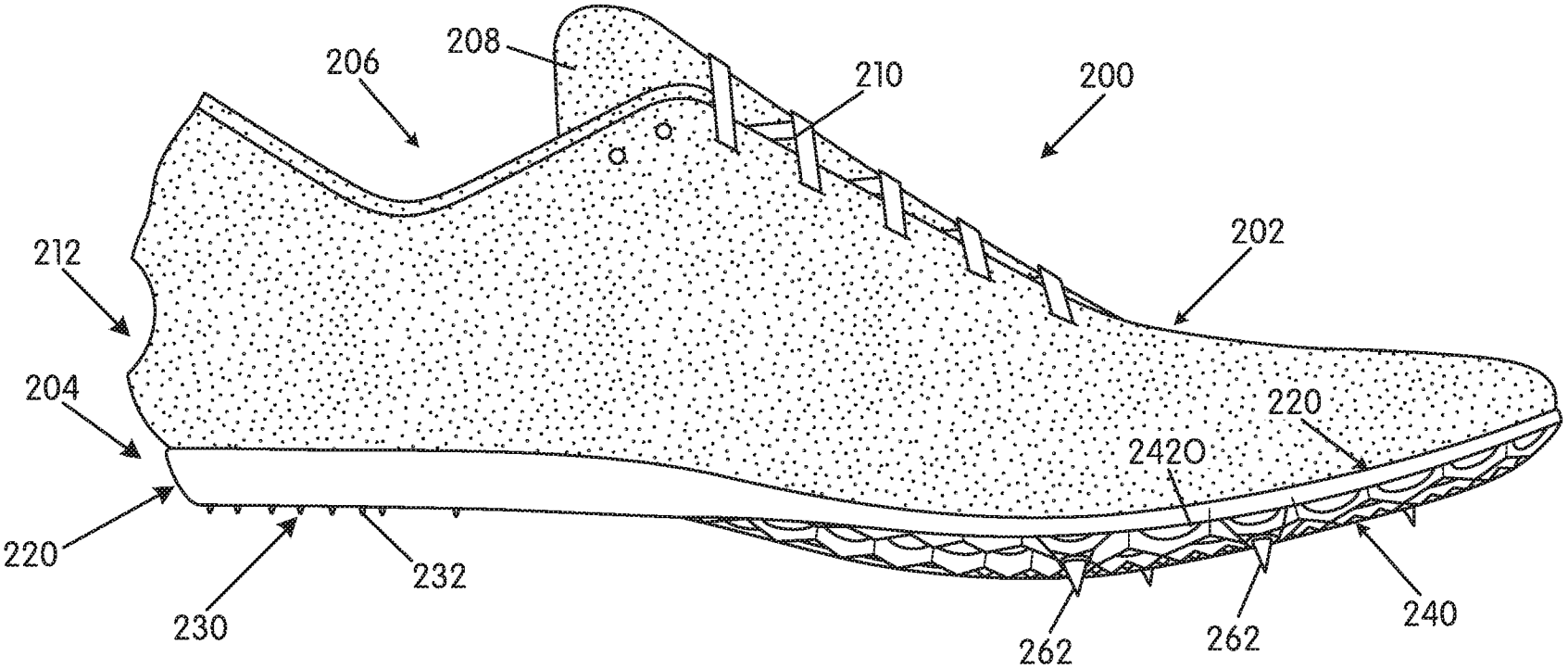
FIGS. 2A-2D provide a lateral side view, a bottom view, an enlarged bottom view around a cleat mount area, and an enlarged perspective view around a cleat mount area, respectively, of an article of footwear in accordance with at least some aspects of this invention.
Figure 2B:
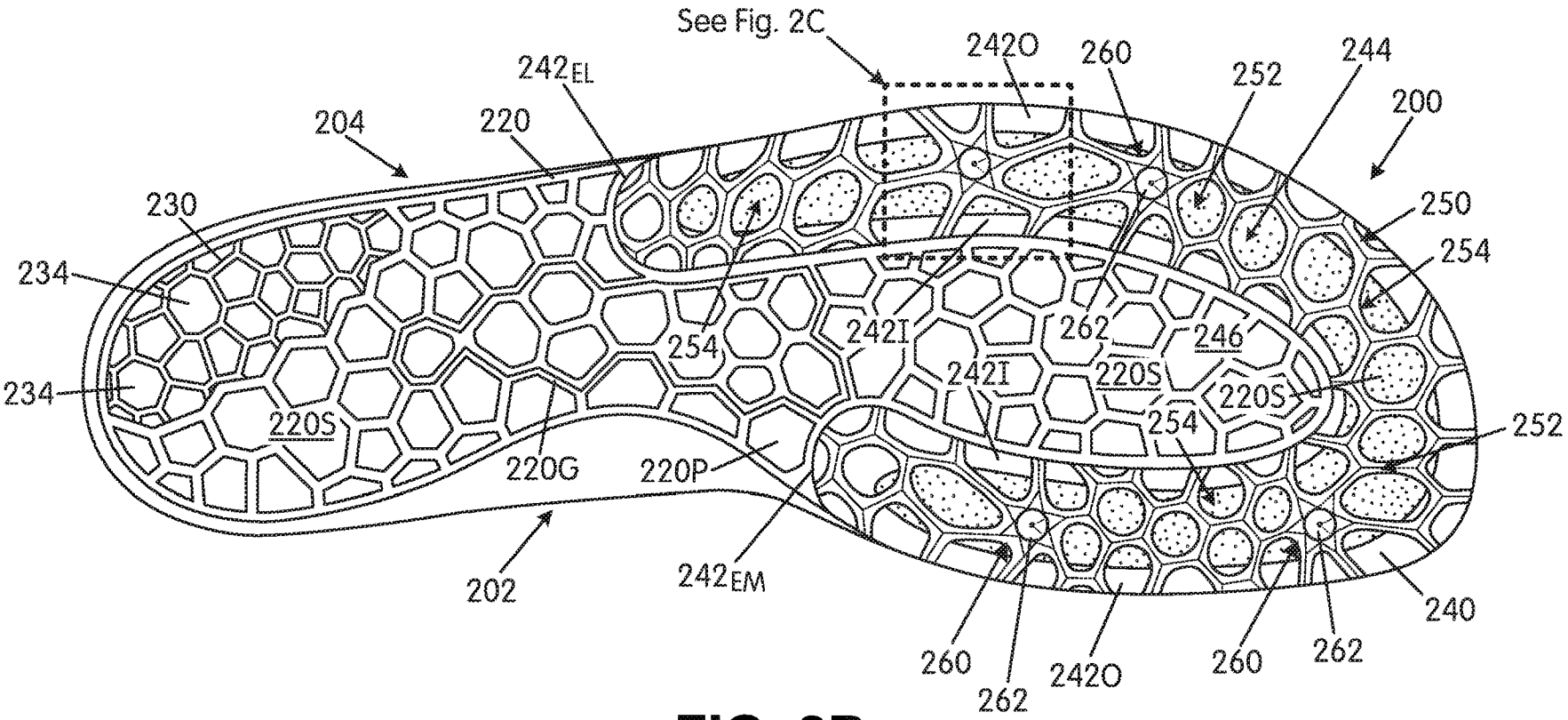
Figure 2D:
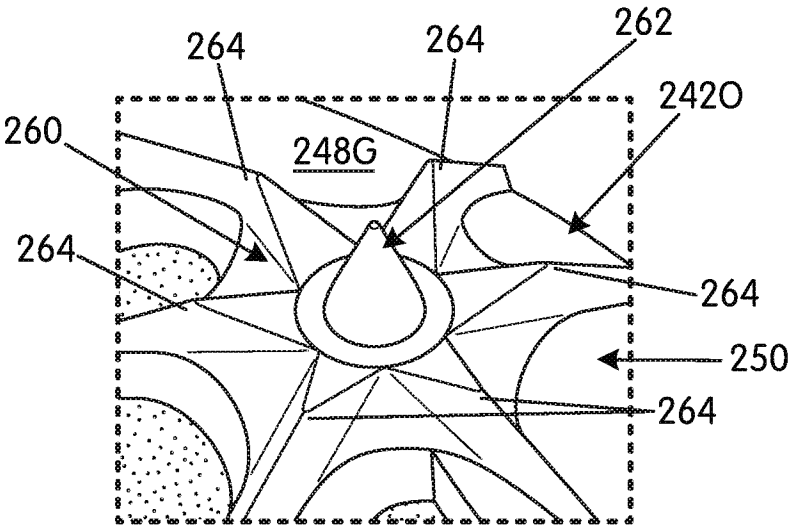

FIGS. 2A and 2B provide lateral side and bottom views, respectively, of an article of footwear 200 in accordance with at least some aspects of this invention. This example article of footwear 200 is a track shoe, and more specifically, a track shoe targeted for relatively long distance runs, such as 3K's, 5K's, 10K's, half marathons, marathons, etc. Aspects of this invention, however, also may be used in shoes for other distance runs and/or other types of uses or athletic activities. The article of footwear 200 includes an upper 202 and a sole structure 204 engaged with the upper 202. The upper 202 and sole structure 204 may be engaged together in any desired manner, including in manners conventionally known and used in the footwear arts (such as by adhesives or cements, by stitching or sewing, by mechanical connectors, etc.).

The upper 202 of this example includes a foot-receiving opening 206 that provides access to an interior chamber into which the wearer's foot is inserted. The upper 202 further includes a tongue member 208 located across the foot instep area and positioned so as to moderate the feel of the closure system 210 (which in this illustrated example constitutes a lace type closure system). In this illustrated example, the rear heel area of the upper 202 includes an opening 212 defined therethrough, and a rear heel area of the wearer's foot may be visible and/or exposed through this opening 212.

As mentioned above, the upper 202 may be made from any desired materials and/or in any desired constructions and/or manners without departing from this invention. As some more specific examples, at least a portion of the upper 202 (and optionally a majority, all, or substantially all of the upper 202) may be formed as a woven textile component and/or a knitted textile component. The textile components for upper 202 may have structures and/or constructions like those provided in FLYKNIT® brand footwear and/or via FLYWEAVE™ technology available in products from NIKE, Inc. of Beaverton, Oreg.

Additionally or alternatively, if desired, the upper 202 construction may include uppers having foot securing and engaging structures (e.g., "dynamic" and/or "adaptive fit" structures), e.g., of the types described in U.S. Patent Appln. Publn. No. 2013/0104423, which publication is entirely incorporated herein by reference. As some additional examples, if desired, uppers and articles of footwear in accordance with this invention may include foot securing and engaging structures of the types used in FLYWIRE® Brand footwear available from NIKE, Inc. of Beaverton, Oreg. Additionally or alternatively, if desired, uppers and articles of footwear in accordance with this invention may include fused layers of upper materials, e.g., uppers of the types included in NIKE's "FUSE" line of footwear products. As still additional examples, uppers of the types described in U.S. Pat. Nos. 7,347,011 and/or 8,429,835 may be used without departing from this invention (each of U.S. Pat. Nos. 7,347,011 and 8,429,835 is entirely incorporated herein by reference).

The sole structure 204 of this example article of footwear 200 now will be described in more detail. As shown in FIGS. 2A and 2B, the sole structure 204 of this example includes three main components: a midsole component 220; a heel reinforcement component 230 located at least at a lateral, rear heel support area of the sole structure 204 (optionally engaged with a bottom surface 220S of the midsole component 220 via adhesives or cements, mechanical fasteners, etc.); and a ground-engaging component 240 located at least around a forefoot perimeter edge of the sole structure 204 (and optionally engaged with the bottom surface 220S of the midsole component via adhesives or cements, mechanical fasteners, etc.). In this manner, the midsole component 220 may be located (a) between a bottom surface of the upper 202 (e.g., a strobel member) and the heel reinforcement component 230 and/or (b) between the bottom surface of the upper 202 and the ground-engaging component 240. The midsole component 220 also may form a portion of the ground-contacting surface of the sole 204. These sole structure 204 components will be described in more detail below.

One main foot support component of this sole structure 204 is the midsole component 220, which in this illustrated example extends to support an entire plantar surface of the wearer's foot (e.g., from the forward-most toe location FT to the rearmost heel location RH and from the lateral side edge to the medial side edge along the entire longitudinal length of the sole structure 204). This midsole component 220, which may be made from one or more parts, may be constructed from a polymeric foam material, such as a polyurethane foam or an ethylvinylacetate ("EVA") foam as are known and used in the footwear arts. Additionally or alternatively, if desired, at least some portion of the midsole component 220 may constitute a fluid-filled bladder, e.g., of the types conventionally known and used in the footwear arts (e.g., available in NIKE "AIR" Brand products), and/or a mechanical shock-absorbing system.

In this illustrated example, a bottom surface 220S of the midsole component 220 is visible/exposed at an exterior of the sole structure 204 substantially throughout the bottom of the sole structure 204 (and at least over more than 50% and even more than 75% of the bottom surface area of the sole structure 204). As shown in FIG. 2B, the bottom surface 220S of the midsole component 220 is exposed at the forefoot area (through open cells 252 and/or partially open cells 254 of the ground-engaging component 240 (also called the "first open space" herein) described in more detail below); in the area between the arms of the ground-engaging component 240 (also called the "second open space" herein); in the arch support area; and in the heel support area (at least at the medial side of the heel support area, and optionally through a matrix structure provided as part of the rear heel reinforcement component 230). The bottom surface 220S of the midsole component 220 may include texturing or other traction-enhancing features, as well as wear pads or other types of reinforcement (e.g., in the higher wear or stress areas). In this illustrated example, the bottom surface 220S of the midsole component 220 has a structure reminiscent of the cellular structure shown in components 230 and 240, although any desired midsole design or features could be provided. If desired, at least some of the area separating the cellular structure (pods 220P) of midsole component 220 may include relatively deep sipes or grooves 220G, e.g., to increase flexibility of the midsole 220.

As further shown in FIG. 2B, the bottom surface 220S of the midsole component 220 may include a recessed area in which the heel reinforcement component 230 is mounted. The heel reinforcement component 230 may have matrix type structure with a plurality of open and/or partially open cells 234 (e.g., a honeycomb-like structure). The heel reinforcement component 230 may be constructed from a sturdier, more wear resistant material than the midsole component 220, such as a PEBAX® plastic material (available from Arkema France Corporation), a thermoplastic polyurethane material, a carbon fiber reinforced plastic material, a glass fiber reinforced plastic material, or the like.

This heel reinforcement component 230 provides additional support and/or wear resistance during the foot-strike phase of a typical running/jogging step cycle (at least for some runners). More specifically, many runners tend to land a running or jogging step on the rear, lateral heel area of the foot. As the step continues, the runner's weight force on the foot tends to roll forward and toward the medial side of the foot for the "push off" or "toe-off" phase of the step cycle. Thus, the lateral heel area of a sole structure 204 may be subjected to substantial force and wear when running, and this heel reinforcement component 230 helps provide support and wear resistance at least at this lateral, rear heel support area of the sole structure 204. If desired, as shown in the example of FIG. 2B, the heel reinforcement component 230 may be located at the lateral, rear heel support area of the sole structure 204 but terminate before reaching a medial heel side of the sole structure 204 (e.g., terminate in a central heel area of the sole structure 204), which can promote flexibility of the sole structure along a line or curve extending in the forward-to-rear direction. Alternatively, if desired, the heel reinforcement component 230 (or another heel reinforcement component) may extend to (or be provided to) protect or support some or all of the medial side of the heel support area.

FIG. 2A further illustrates that the heel reinforcement component 230 includes ground-engaging traction elements 232. The ground-engaging traction elements 232 in this example are short, sharp points (e.g., less than 3 mm (0.12 inches) tall) that extend from the matrix structure of the heel reinforcement component 230. In this illustrated example, the sharp point traction elements 232 are provided at the corners of the matrix structure of the heel reinforcement component 230 between the open and/or partially open cells 234 (although they could be provided at other locations, if desired). The sharp point traction elements 232 may be integrally formed as part of the heel reinforcement component 230, e.g., by molding them into the heel reinforcement component 230 when the part is made.

The ground-engaging component 240 of this example sole structure 204/article of footwear 200 now will be described in more detail with reference to FIGS. 2A through 2D as well as with reference to FIGS. 3A and 3B. As shown, this example ground-engaging component 240 includes an outer perimeter boundary rim 242O, for example, that may be at least 3 mm (0.12 inches) wide (and in some examples, is at least 4 mm (0.16 inches) wide, at least 6 mm (0.24 inches) wide, or even at least 8 mm (0.32 inches) wide). This "width" $W_O$ is defined as the direct, shortest distance from one edge (e.g., an exterior edge) of the outer perimeter boundary rim 242O to its opposite edge (e.g., an interior edge), as shown in FIGS. 3A and 3B. While FIGS. 2B, 3A, and 3B show this outer perimeter boundary rim 242O extending completely and continuously around and defining 100% of an outer perimeter of the ground-engaging component 240, other options are possible. For example, if desired, there may be one or more breaks in the outer perimeter boundary rim 242O at the outer perimeter such that the outer perimeter boundary rim 242O is present around only at least 75%, at least 80%, at least 90%, or even at least 95% of the outer perimeter of the ground-engaging component 240. The outer perimeter boundary rim 242O may have a constant or changing width $W_O$ over the course of the outer perimeter of the ground-engaging component 240. The outer perimeter boundary rim 242O also may extend to define the outer edge of at least a portion of the sole structure 204 (e.g., at least in some portion(s) of the forefoot and/or midfoot areas).

This example ground-engaging component 240 further includes an inner perimeter boundary rim 242I, for example, that may be at least 3 mm (0.12 inches) wide (and in some examples, is at least 4 mm (0.16 inches) wide, at least 6 mm (0.24 inches) wide, or even at least 8 mm (0.32 inches) wide). This "width" $W_I$ is defined as the direct, shortest distance from one edge (e.g., an interior edge) of the inner perimeter boundary rim 242I to its opposite edge (e.g., an exterior edge), as shown in FIGS. 3A and 3B. While FIGS. 2B, 3A, and 3B show this inner perimeter boundary rim 242I extending completely and continuously around and defining 100% of an inner perimeter of the ground-engaging component 240, other options are possible. For example, if desired, there may be one or more breaks in the inner perimeter boundary rim 242I at the inner perimeter such that the inner perimeter boundary rim 242I is present around only at least 75%, at least 80%, at least 90%, or even at least 95% of the inner perimeter of the ground-engaging component 240. The inner perimeter boundary rim 242I may have a constant or changing width $W_I$ over the course of the inner perimeter of the ground-engaging component 240. The combination of the outer perimeter boundary rim 242O and the inner perimeter boundary rim 242I may be formed together as a unitary, one piece construction and/or may form a generally U-shaped component that includes at least a lateral side forefoot support area (and optionally a lateral side midfoot support area), a front forefoot support area, and a medial side forefoot support area (and optionally a medial side midfoot support area). $W_O$ and $W_I$ may be the same or different in a given ground-engaging component 240 structure.

In this illustrated example structure, the outer perimeter boundary rim 242O is connected with the inner perimeter boundary rim 242I: (a) at a first free end boundary rim $\mathbf{242}_{EL}$ located at a lateral side forefoot support area or a lateral side midfoot support area of the ground-engaging component 240 and/or (b) at a second free end boundary rim $\mathbf{242}_{EM}$ located at a medial side forefoot support area or a medial side midfoot support area of the ground-engaging component 240. This illustrated ground-engaging component 240 has its second free end boundary rim $\mathbf{242}_{EM}$ (on the medial side) located closer to a front forefoot support area (e.g., the foremost toe FT location) of the ground-engaging component 240 and/or sole structure 204 than is the first free end boundary rim $\mathbf{242}_{EL}$ (on the lateral side).

As further shown in FIGS. 2A-3B, the outer perimeter boundary rim 242O and the inner perimeter boundary rim 242I are structured and arranged such that a "first open space" 244 is defined between the outer perimeter boundary rim 242O and the inner perimeter boundary rim 242I. This "first open space" 244 extends through the interior of the U-shaped area of the ground-engaging component 240 (and includes at least portions of the support structure 250, as will be described in more detail below). As further shown in these figures, a "second open space" 246 is defined between a lateral side portion of the inner perimeter boundary rim 242I and a medial side portion of the inner perimeter boundary rim 242I.

As noted above, the ground-engaging component 240 of this illustrated example is a generally U-shaped member (albeit U-shaped with different length sides or legs). While other sizes are possible without departing from this invention, in at least some example structures in accordance with this invention, the ground-engaging component 240 will have an overall width dimension $W_C$ at locations around the U-shaped component 240 of no more than 1.75 inches (44.5 mm) around at least 60% of the outer perimeter of the ground-engaging component 240, and in some examples, no more than 1.75 inches (44.5 mm) around at least 70%, at least 80%, at least 90%, or even at least 95% of the outer perimeter of the ground-engaging component 240. In some examples, this overall width dimension $W_C$ around the U-shaped component will be no more than 2 inches (50.8 mm), no more than 1.5 inches (38.1 mm), and in some examples, no more than 1.25 inches (31.8 mm), around at least 60% of the outer perimeter of the ground-engaging component 240; and in some examples, no more than 2 inches (50.8 mm), no more than 1.5 inches (38.1 mm), and in some examples, no more than 1.25 inches (31.8 mm), around at least 70%, at least 80%, at least 90%, or even at least 95% of the outer perimeter of the ground-engaging component 240. This "width" $W_C$ is defined as the direct, shortest distance from an interior edge of the inner perimeter boundary rim 242I to an exterior edge of the outer perimeter boundary rim 242O at locations around the perimeter, e.g., as shown in FIGS. 3A and 3B.

The outer perimeter boundary rim 242O and the inner perimeter boundary rim 242I of this illustrated example ground-engaging component 240 define an upper-facing surface 248U (e.g., as shown in FIG. 3A) and a ground-facing surface 248G (e.g., as shown in FIGS. 2B and 3B) opposite the upper-facing surface 248U. The upper-facing surface 248U provides a surface (e.g., smooth and/or contoured surface) for supporting the wearer's foot and/or engaging the midsole component 220 (and/or optionally engaging the upper 202, if no exterior midsole is present at some or all locations of the sole structure 204). The inner perimeter boundary rim 242I and the outer perimeter boundary rim 242O may provide a relatively large surface area for securely supporting a portion of a plantar surface of a wearer's foot. Further, the inner perimeter boundary rim 242I and the outer perimeter boundary rim 242O may provide a relatively large surface area for securely engaging another footwear component (such as the bottom surface 220S of the midsole component 220 and/or a bottom surface of the upper 202), e.g., a surface for bonding via adhesives or cements, for supporting stitches or sewn seams, for supporting mechanical fasteners, etc.

FIGS. 2B through 3B further illustrate that the ground-engaging component 240 of this example sole structure 204 includes a support structure 250 that extends from the outer perimeter boundary rim 242O to the inner perimeter boundary rim 242I and across the first open space 244. The top surface of this example support structure 250 at locations within the first open space 244 lies flush with and/or smoothly transitions into the outer perimeter boundary rim 242O and/or the inner perimeter boundary rim 242I to provide a portion of the upper-facing surface 248U (and may be used for the purposes of the upper-facing surface 248U as described above).

The support structure 250 of these examples extends from the ground-facing surfaces 248G of the outer perimeter boundary rim 242O and the inner perimeter boundary rim 242I to define a portion of the ground-facing surface of the ground-engaging component 240. In the illustrated example of FIGS. 2A-3B, the support structure 250 includes a matrix structure (also labeled 250 herein) extending from the ground-facing surfaces 248G of the inner perimeter boundary rim 242I and/or the outer perimeter boundary rim 242O and across the first open space 244 to define a cellular construction. The illustrated matrix structure 250 defines at least one of: (a) one or more open cells located within the first open space 244 or (b) one or more partially open cells located within the first open space 244. An "open cell" constitutes a cell in which the perimeter of the cell opening is defined completely by the matrix structure 250 (note, for example, cells 252 in FIG. 2B). A "partially open cell" constitutes a cell in which one or more portions of the perimeter of the cell opening is defined by the matrix structure 250 within the open space 244 and one or more other portions of the perimeter of the cell opening is defined by another structure, such as the inner perimeter boundary rim 242I and/or the outer perimeter boundary rim 242O (note, for example, cells 254 in FIGS. 2B and 3B). A "closed cell" may have the matrix structure 250 but no opening (e.g., it may be formed such that the portion that would constitute the cell opening is located under one of the boundary rims 242O, 242I). Also, in this illustrated structure 250, at least 50% of the open cells 252 and/or partially open cells 254 (and optionally at least 60%, at least 70%, at least 80%, at least 90%, or even at least 95%) have openings with curved perimeters and no distinct corners (e.g., round, elliptical, and/or oval shaped as viewed at least from the upper-facing surface 248U). The open space 244 and/or matrix structure 250 may extend to all areas of the ground-engaging component 240 between the outer perimeter boundary rim 242O and the inner perimeter boundary rim 242I. The sizes of the cell 252/254 openings may be varied without departing from this invention (e.g., to provide larger and/or smaller sized cell openings or partial openings).

Figure 2C:
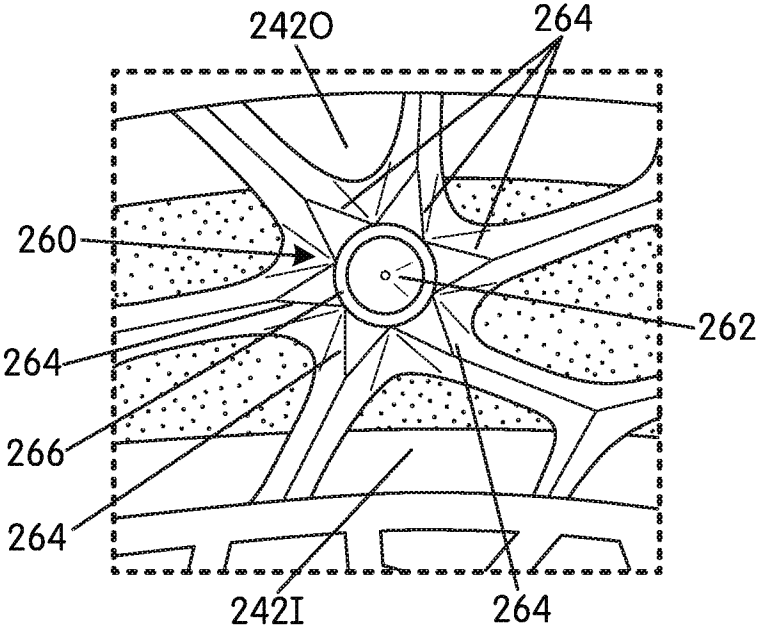
Figure 3A:
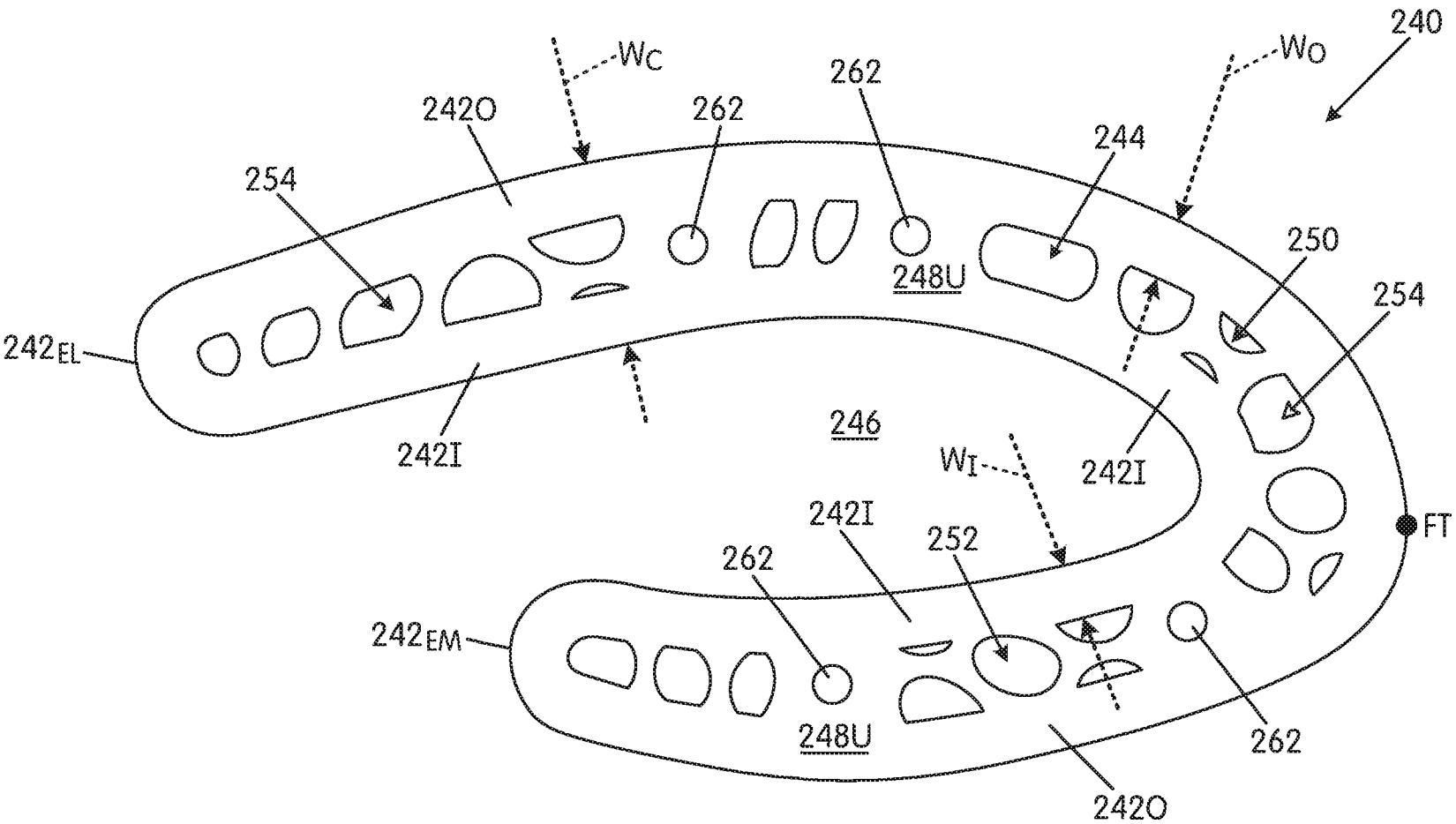
FIGS. 3A and 3B provide a top view and a bottom view, respectively, of a ground-engaging component in accordance with at least some aspects of this invention.
Figure 3B:
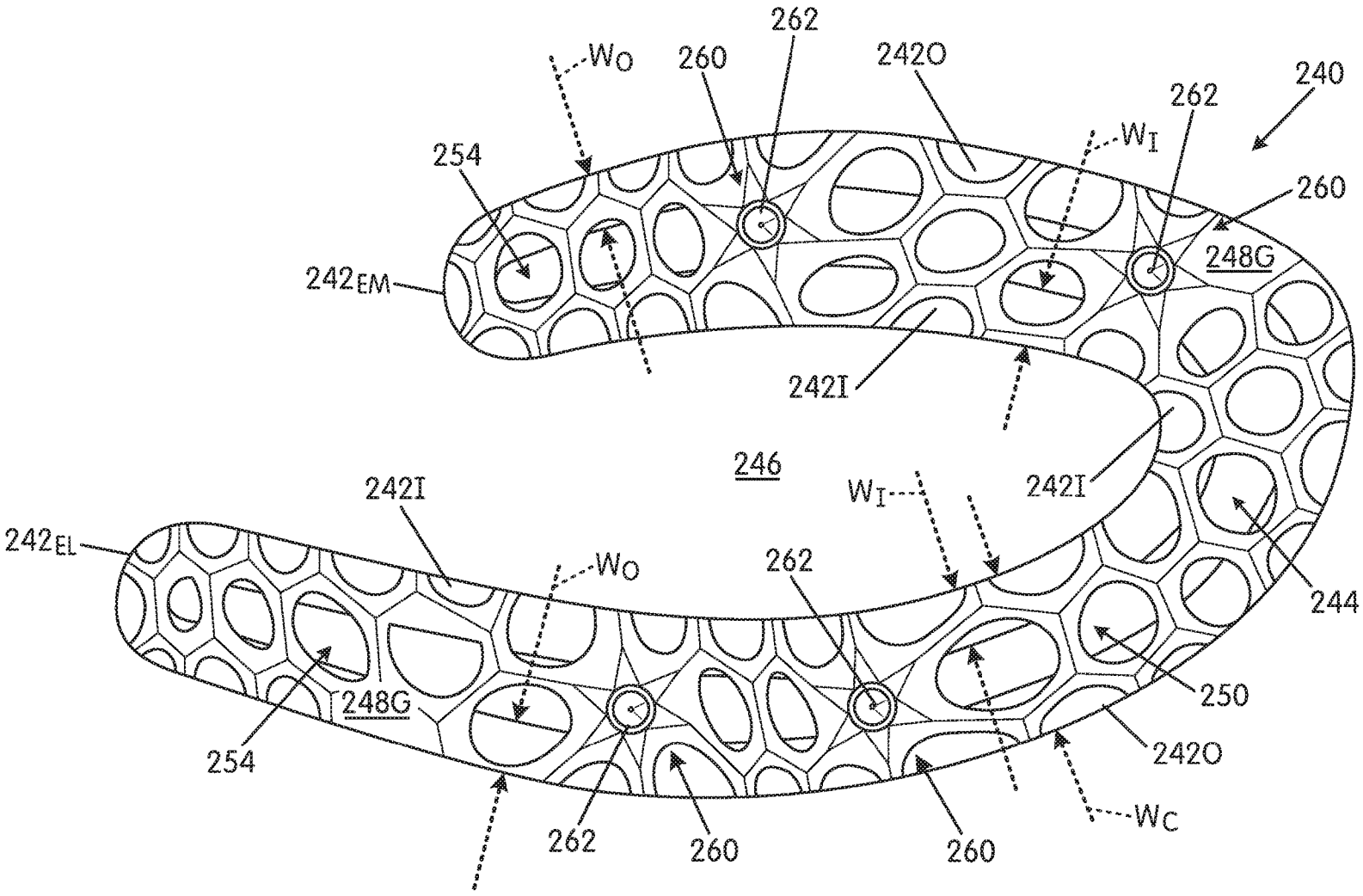

As further shown in FIGS. 2B, 2C, and 3B, the matrix structure 250 further defines one or more primary traction element or cleat support areas 260. Four separate cleat support areas 260 are shown in the examples of FIGS. 2A-3B, with: (a) two primary cleat support areas 260 on the lateral side of the ground-engaging component 240 (one at or near a lateral forefoot support area or a lateral midfoot support area of the ground-engaging component 240 and one forward of that one in the lateral forefoot support area) and (b) two primary cleat support areas 260 on the medial side of the ground-engaging component 240 (one at or near a medial forefoot support area or a medial midfoot support area of the ground-engaging component 240 and one forward of that one in the medial forefoot support area). The forward-most medial cleat support area 260 is located closer to a forward-most toe location (FT) of the ground-engaging component 240 than is the forward-most lateral cleat support area 260 (to better support and engage the ground during the "toe-off" phase of a step cycle). Primary traction elements, such as track spikes 262 or other cleats, may be engaged or integrally formed at the cleat support areas 260 (e.g., with one cleat or track spike 262 provided per cleat support area 260). The cleats or track spikes 262 (also called "primary traction elements" herein) may be permanently fixed in their associated cleat support areas 260, such as by in-molding the cleats or track spikes 262 into the cleat support areas 260 when the matrix structure 250 is formed (e.g., by molding). In such structures, the cleat or track spike 262 may include a disk or outer perimeter member that is embedded in the material of the cleat support area 260 during the molding process. As another alternative, the cleats or track spikes 262 may be removably mounted to the ground-engaging component 240, e.g., by a threaded type connector, a turnbuckle type connector, or other removable cleat/spike structures as are known and used in the footwear arts. Hardware or other structures for mounting the removable cleats may be integrally formed in the mount area 260 or otherwise engaged in the mount area (e.g., by in molding, adhesives, or mechanical connectors).

The cleat support areas 260 can take on various structures without departing from this invention. In the illustrated example, the cleat support areas 260 are defined by and as part of the matrix structure 250 as a thicker portion of matrix material extending between the outer perimeter boundary rim 242O and the inner perimeter boundary rim 242I. In this manner, one or more of the cleat support areas 260 extend into and/or across the first open space 244. As other options, if desired, one or more of the cleat support areas 260 may be defined in one or more of the following areas: (a) solely in the outer perimeter boundary rim 242O, (b) solely in the inner perimeter boundary rim 242I, (c) partially in the outer perimeter boundary rim 242O and partially in the open space 244, and/or (d) partially in the inner perimeter boundary rim 242I and partially in the open space 244. When multiple cleat support areas 260 are present in a single ground-engaging component 240, all of the cleat support areas 260 need not have the same size, construction, and/or orientation with respect to the boundary rims and/or open space (although they all may have the same size, construction, and/or orientation, if desired).

While other constructions are possible, in this illustrated example (e.g., see FIGS. 2B-2D), the cleat support areas 260 are formed as generally hexagonal shaped areas of thicker material into which or at which at least a portion of the cleat/spike 262 and/or mounting hardware therefor will be fixed or otherwise engaged. The cleat support areas 260 are integrally formed as part of the matrix structure 250 in this illustrated example. The illustrated example further shows that the matrix structure 250 defines a plurality of secondary traction elements 264 dispersed around the cleat support areas 260. While other options and numbers of secondary traction elements 264 are possible, in this illustrated example, a secondary traction element 264 is provided at each of the six corners of the generally hexagonal structure making up the cleat support area 260 (such that each cleat support area 260 has six secondary traction elements 264 dispersed around it). The secondary traction elements 264 of this example are raised, sharp points or pyramid type structures made of the matrix material and raised above a base surface 266 of the generally hexagonal cleat support area 260. The free ends of the primary traction elements 262 extend beyond the free ends of the secondary traction elements 264 (in the cleat extension direction and/or when the shoe 200 is positioned on a flat surface S) and are designed to engage the ground first. Note FIG. 2D. If the primary traction elements 262 sink a sufficient depth into the contact surface (e.g., a track, the ground, etc.), the secondary traction elements 264 then may engage the contact surface and provide additional traction to the wearer. In an individual cleat mount area 260 around a single primary traction element 262, the points or peaks of the immediately surrounding secondary traction elements 264 that surround that primary traction element 262 may be located within 1.5 inches (3.8 cm) (and in some examples, within 1 inch (2.5 cm) or even within 0.75 inch (1.9 cm)) of the peak or point of the surrounded primary traction element 262 in that mount area 260.

In at least some examples of this invention, the outer perimeter boundary rim 242O, the inner perimeter boundary rim 242I, and the support structure 250 extending into/across the first open space 244 may constitute an unitary, one piece construction. The one-piece construction can be formed from a polymeric material, such as a PEBAX® brand polymer material or a thermoplastic polyurethane material. As another example, if desired, the ground-engaging component 240 may be made as multiple parts (e.g., split at the forward-most toe area and/or other areas), wherein each part includes one or more of: at least a portion of the outer perimeter boundary rim 242O, at least a portion of the inner perimeter boundary rim 242I, and at least a portion of the support structure 250. As another option, if desired, rather than an unitary, one piece construction, one or more of the outer perimeter boundary rim 242O, the inner perimeter boundary rim 242I, and the support structure 250 may individually be made of two or more parts.

Optionally, the outer perimeter boundary rim 242O, the inner perimeter boundary rim 242I, and the support structure 250, whether made from one part or more, will have a combined mass of less than 40 grams (exclusive of any separate primary traction elements, like spikes 262), and in some examples, a combined mass of less than 35 grams, less than 30 grams, less than 25 grams, less than 20 grams, less than 18 grams, or even less than 16 grams. The entire ground-engaging component 240 also may have any of these same weighting characteristics. The ground-engaging component 240, in its final form, may be relatively flexible and pliable, e.g., so as to generally be capable of flexing and/or moving naturally with a wearer's foot during ambulatory activities and running/jogging events.

Figure 4:
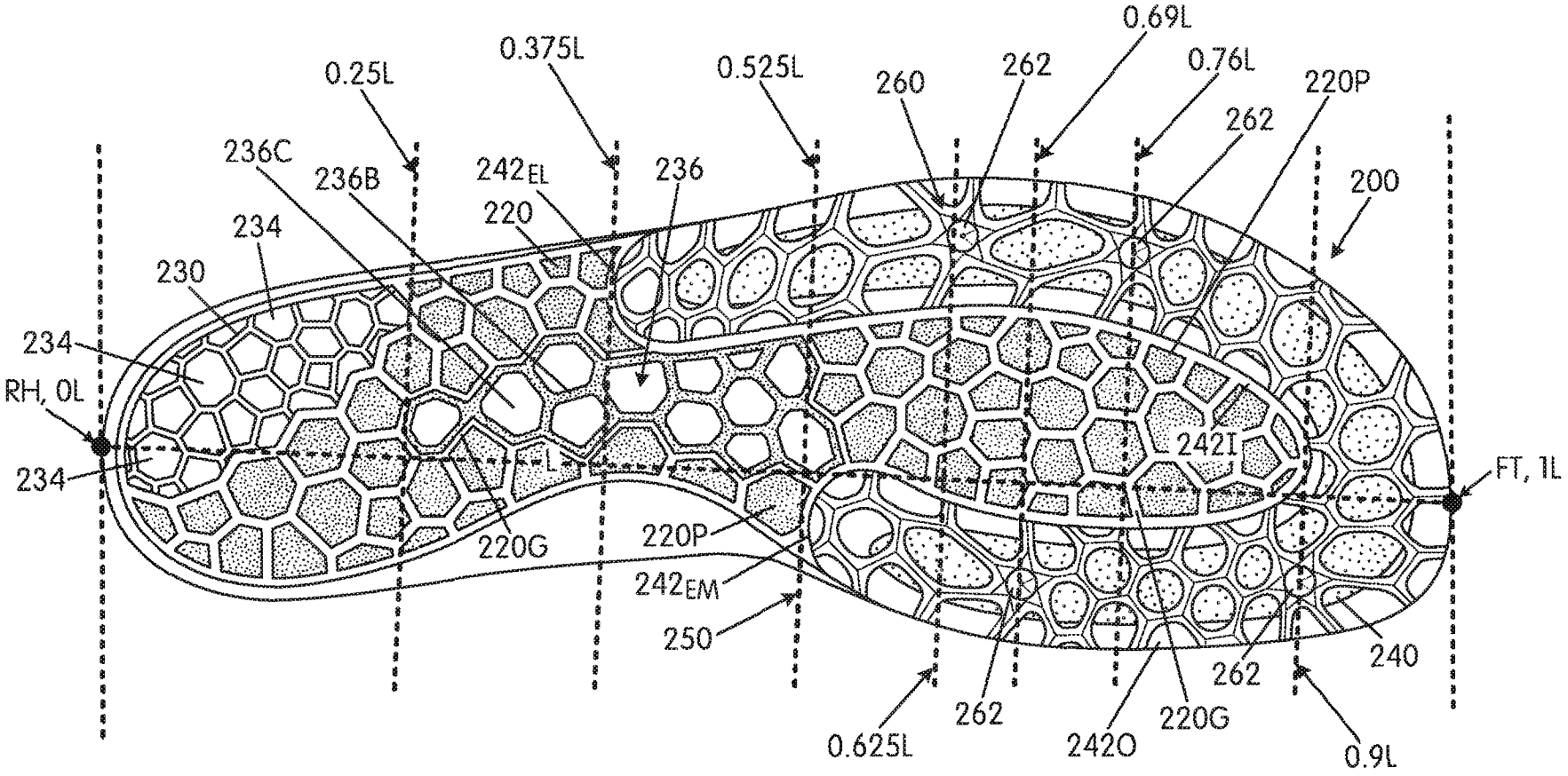
FIG. 4 is a bottom view of a sole structure in accordance with one example of this invention that illustrates additional example features of some aspects of the invention.
Figure 5B:
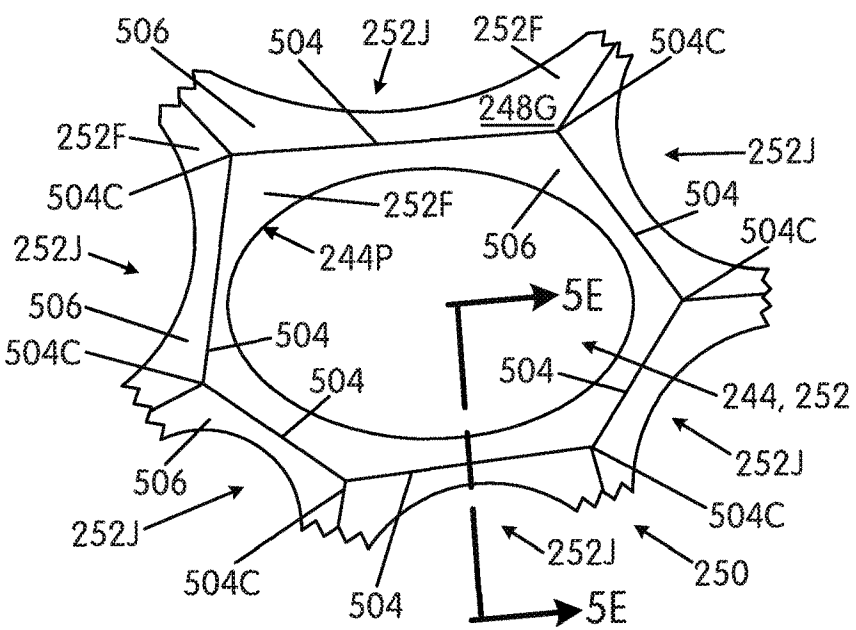
FIGS. 5A-5H provide various views to illustrate additional features of the ground-engaging component's support structure in accordance with some example features of this invention.
Figure 5A:
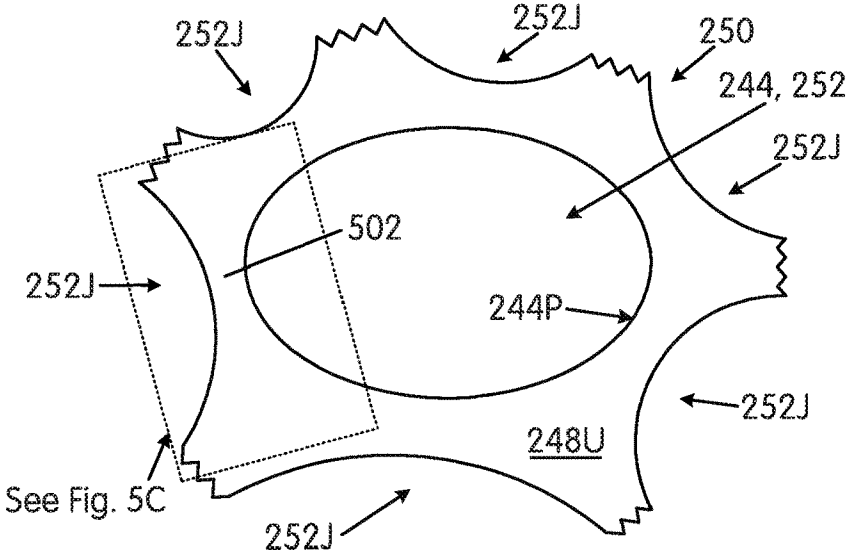
Figure 5E:
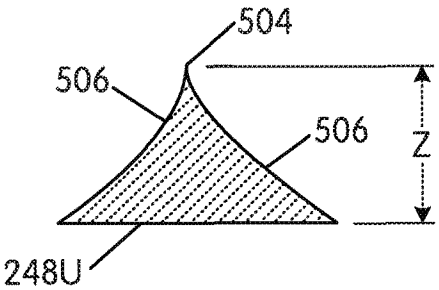
Figure 5D:
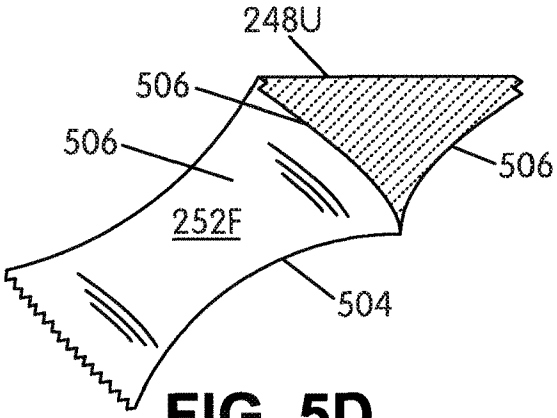
Figure 5C:
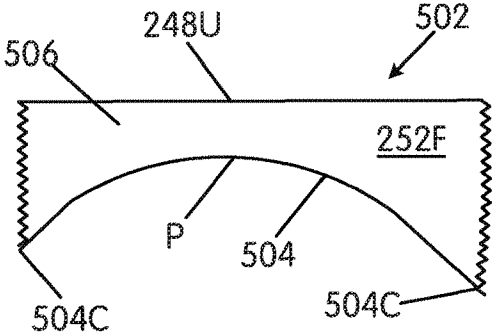
Figure 5G:
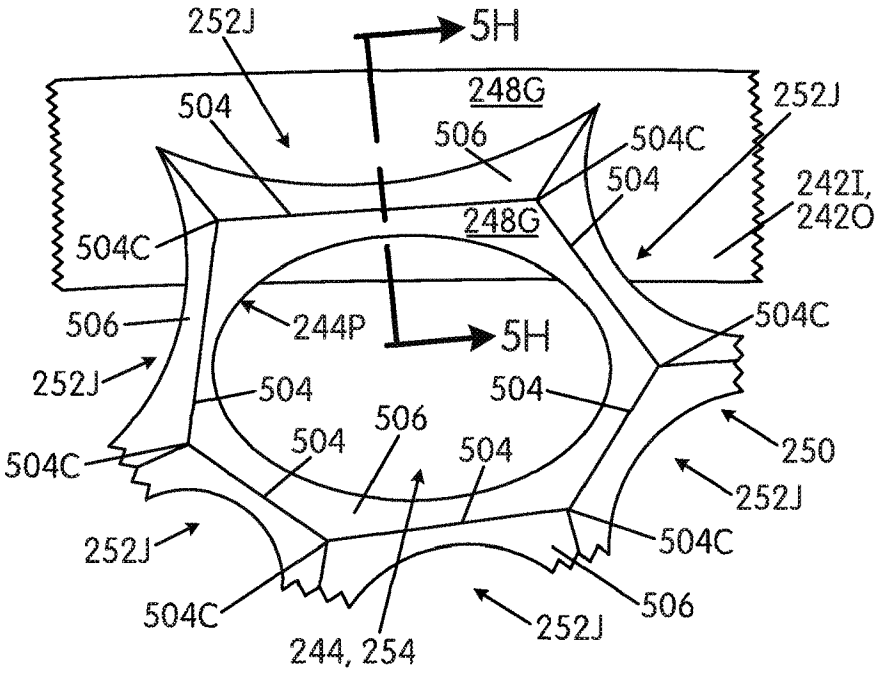
Figure 5F:
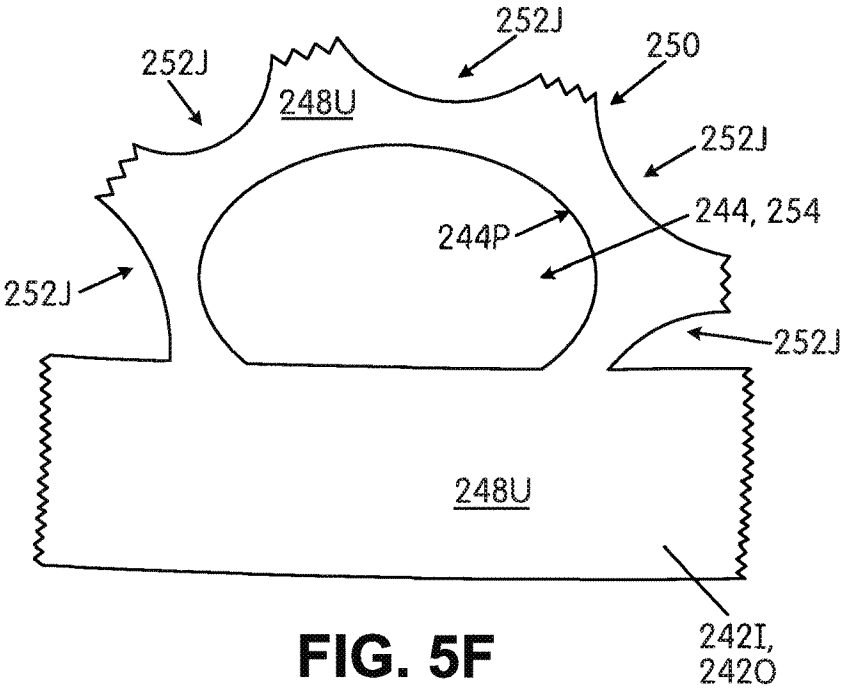
Figure 5H:
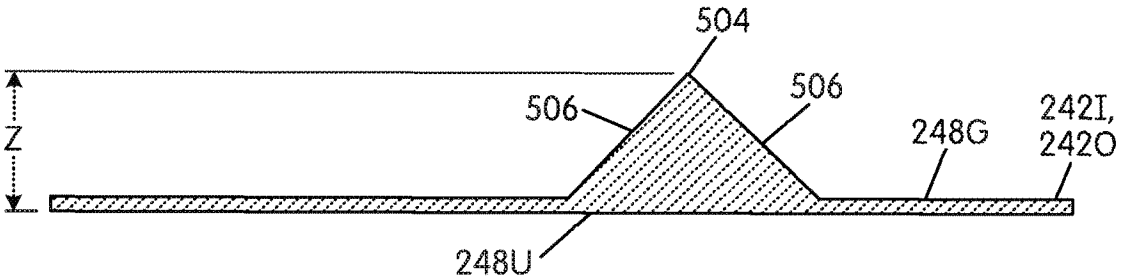

FIGS. 4 through 5H are provided to illustrate additional features that may be present in ground-engaging components and/or articles of footwear in accordance with at least some aspects of this invention. FIG. 4 is a view similar to that of FIG. 2B with the rear heel RH and forward toe FT locations of the sole structure 204 identified and the longitudinal length L and direction identified. Planes perpendicular to the longitudinal direction (and going into and out of the page in the transverse direction) are shown, and the locations of various footwear 200 and/or ground-engaging component 240 features are described with respect to these planes. For example, FIG. 4 illustrates that the heel reinforcement component 230 is structured and arranged so as to extend to a location of 0.25L in the lateral heel support area. In some examples of this invention, the forward-most extent of the heel reinforcement component 230 may be within a range of 0.15L to 0.35L, and in some examples, within a range of 0.2L to 0.3L based on the sole structure 204's and/or footwear 200's longitudinal length L.

As another example, FIG. 4 illustrates that the rear-most extent of the lateral side of the ground-engaging component 240 is located at 0.375L. In some examples of this invention, this rear-most extent of the lateral side of the ground-engaging component 240 may be located within a range of 0.275L and 0.6L, and in some examples, within a range of 0.3L to 0.55L or even 0.32L to 0.5L (based on the sole structure 204's and/or footwear 200's longitudinal length L). Similarly, as shown in FIG. 4, the rear-most extent of the medial side of the ground-engaging component 240 is located at about 0.525L in this example, but this rear-most extent of the medial side of the ground-engaging component 240 may be within a range of 0.4L to 0.65L or even 0.45L to 0.625L (based on the sole structure 204's and/or footwear 200's longitudinal length L). While the rear-most extents of the lateral and medial sides of the ground-engaging element 240 may be separated by any desired longitudinal distance (including no longitudinal separation distance), in some examples of this invention, this separation distance will be within a range of 0L to 0.3L, and in some examples, within a range of 0.05L to 0.25L or even 0.1L to 0.2L. While the medial side rear-most extent is located more forward than the lateral side rear-most extent in this example, this is not a requirement in all examples of this invention (e.g., the two rear-most extents may be equal or the medial side may extend further rearward than the lateral side).

Potential primary traction element attachment locations for two primary traction elements 262 on each side of the ground-engaging component 240 are described in the following table (with the "locations" being measured from a center location (or point) of the ground-contacting portion of the cleat/spike 262, based on the sole structure 204's and/or footwear 200's longitudinal length L):

| | General Range | More Specific Range | More Specific Range | Illustrated Location |
|---|---|---|---|---|
| Rear Lateral Cleat | 0.5 L to 0.75 L | 0.53 L to 0.7 L | 0.55 L to 0.68 L | 0.625 L |

-continued

| | General Range | More Specific Range | More Specific Range | Illustrated Location |
|---|---|---|---|---|
| Forward Lateral Cleat | 0.62 L to 0.88 L | 0.64 L to 0.86 L | 0.7 L to 0.82 L | 0.76 L |
| Separation of Lateral Cleats | 0.075 L to 0.25 L | 0.1 L to 0.2 L | 0.12 L to 0.18 L | 0.135 L |
| Rear Medial Cleat | 0.57 L to 0.84 L | 0.6 L to 0.8 L | 0.63 L to 0.76 L | 0.69 L |
| Forward Medial Cleat | 0.75 L to 0.96 L | 0.8 L to 0.95 L | 0.84 L to 0.94 L | 0.9 L |
| Separation of Medial Cleats | 0.1 L to 0.3 L | 0.14 L to 0.27 L | 0.16 L to 0.25 L | 0.21 L |

If desired, one or more additional primary traction elements 262 can be provided rearward of one or both of the identified rear cleats, between one or both sets of the rear and/or forward cleats, and/or forward of one or both of the forward cleats. In the illustrated example, each lateral cleat is located further rearward in the longitudinal direction L than its corresponding medial cleat (i.e., the rear lateral cleat is further rearward than the rear medial cleat and/or the forward lateral cleat is further rearward than the forward medial cleat).

FIG. 4 further illustrates that the forward-most extent of the inner perimeter boundary rim 242I of this example (i.e., the inside bottom of the U-shape) is located at 0.9L (and about at the same general longitudinal plane with the forward-most medial side primary traction element 262 in this example). In some examples of this invention, this forward-most extent of the inner perimeter boundary rim 242I (i.e., the inside bottom of the U-shape) may be located within a range of 0.75L and 0.98L, and in some examples, within a range of 0.8L to 0.96L or even 0.85L to 0.94L. Also, while the illustrated example shows the forward-most extent of the outer perimeter boundary rim 242O located at 1.0L (at the forward-most toe location FT of the sole structure 204 and/or footwear structure 200), this forward-most extent of the outer perimeter boundary rim 242O may be located within a range of 0.95L and 1.0L, and in some examples, within a range of 0.97L to 1.0L.

FIG. 4 illustrates additional potential features of sole structures 204 in accordance with at least some examples of this invention. Like those described above in conjunction with FIGS. 2A and 2B, this example sole structure 204 includes a ground-engaging component 240 and a heel reinforcement 230 (e.g., with an open cell 234 or honeycomb-like structure) engaged with a midsole component 220, e.g. engaged in a recess formed in the midsole component 220 and/or located within gaps or spaces between separate midsole 220 component parts and/or other footwear 200 component parts. Also like FIGS. 2A and 2B, the exposed midsole component 220 at the bottom of this example sole structure 204 includes midsole pods 220P (e.g., formed from a foam material, for example, of the types described above and/or of the types conventionally used in footwear midsole constructions) with relatively deep sipes or grooves 220G formed in the midsole 220 material between adjacent pods 220P (the sipes or grooves 220G define and separate the pods 220P at the bottom surface 220S). The deep sipes or grooves 220G can help provide flexibility and/or natural motion to the sole structure 204.

In this illustrated example sole structure 204, an additional arch support member 236 is provided. This specific example arch support member 236 has an open cell construction (e.g., with open cells 236C separated by beam members 236B and/or a honeycomb-like structure), although other constructions are possible without departing from this invention (including an arch support plate or the like). The arch support member 236 of this example constitutes a separate part, e.g., that is engaged in a recess formed in the midsole component 220 and/or is located within gaps or spaces between separate midsole 220 component parts and/or other footwear 200 component parts. The arch support member 236 may be made from a material that is stiffer and/or harder than the material of the midsole component 220 (e.g., such as a PEBAX® plastic material (available from Arkema France Corporation), a thermoplastic polyurethane material, a carbon fiber reinforced plastic material, a glass fiber reinforced plastic material, or the like). As another option, the arch support member 236 may be formed of a harder and/or stiffer foam material than the foam material of the rest of midsole component 220. If desired, the bottom 220S of the midsole component 220 may be visible and/or exposed through the open cells 236C of the arch support member 236 (and/or also through the open cells 234 of the heel reinforcement member 230).

FIGS. 5A through 5H are provided to help illustrate potential features of the matrix structure 250 and the various cells described above. FIG. 5A provides an enlarged top view showing the upper-facing surface 248U at an area around an open cell 252 defined by the matrix structure 250 (the open space is shown at 244). FIG. 5B shows an enlarged bottom view of this same area of the matrix structure 250 (showing the ground-facing surface 248G). FIG. 5C shows a side view at one leg 502 of the matrix structure 250 and FIG. 5D shows a cross-sectional and partial perspective view of this same leg 502 area. As shown in these figures, the matrix structure 250 provides a smooth top (upper-facing) surface 248U but a more angular ground-facing surface 248G. More specifically, at the ground-facing surface 248G, the matrix structure 250 defines a generally hexagonal ridge 504 around the open cell 252, with the corners 504C of the hexagonal ridge 504 located at a junction area between three adjacent cells and/or partial cells in a generally triangular arrangement (the open cell 252 and two adjacent cells or partial cells 252J, which may be open or partially open cells, partially open cells, partial cells, and/or closed cells in this illustrated example). Some cells or partial cells (open, partially open, or closed) will have six other cells or partial cells adjacent and arranged around them (e.g., in the generally triangular arrangement of adjacent cells, as mentioned above). A cell or partial is "adjacent" to another cell or partial cell if a straight line can be drawn to connect openings of the two cells/partial cells without that straight line crossing through the open space of another cell or partial cell or passing between two other adjacent cells or partial cells and/or if the cells/partial cells share a wall.

"Adjacent cells" (or partial cells) also may be located close to one another (e.g., so that a straight line distance between the openings of the cells is less than 1 inch long (and in some examples, less than 0.5 inches long). A "partial cell" means an incomplete open, partially open, or closed cell that terminates at an edge of the ground-engaging component 240 (e.g., as shown in FIG. 5G discussed below).

As further shown in these figures, along with FIG. 5E (which shows a sectional view along line 5E-5E of FIG. 5B), the side walls 506 between the upper-facing surface 248U at cell perimeter 244P and the ground-facing surface 248G, which ends at ridge 504 in this example, are sloped. Thus, the overall matrix structure 250, at least at some locations between the generally hexagonal ridge 504 corners 504C, may have a triangular or generally triangular shaped cross section (e.g., see FIGS. 5D and 5E). Moreover, as shown in FIGS. 5C and 5D, the generally hexagonal ridge 504 may be sloped or curved from one corner 504C to the adjacent corners 504C (e.g., with a local maxima point P located between adjacent corners 504C). The side walls 506 may have a planar surface (e.g., like shown in FIG. 5H), a partially planar surface (e.g., planar along some of its height/thickness dimension Z), a curved surface (e.g., a concave surface as shown in FIG. 5E), or a partially curved surface (e.g., curved along some of its height dimension Z).

The raised corners 504C of the generally hexagonal ridge 504 in this illustrated example ground-engaging component 240 may be formed as sharp peaks that may act as secondary traction elements at desired locations around the ground-engaging component 240. As evident from these figures and the discussion above, the generally hexagonal ridges 504 and side walls 506 from three adjacent cells (e.g., 252 and two 252J cells) meet at a single (optionally raised) corner 504C and thus may form a substantially pyramid type structure (e.g., a pyramid having three side walls 252F that meet at a point 504C). This substantially pyramid type structure can have a sharp point (e.g., depending on the slopes of walls 252F), which can function as a secondary traction element when it contacts the ground in use. This same type of pyramid structure formed by matrix 250 also may be used to form the secondary traction elements 264 at cleat support areas 260.

Not every cell or partial cell (open, partially open, or closed) in the ground-engaging component 240 needs to have this type of secondary traction element structure (e.g., with raised pointed pyramids at the generally hexagonal ridge 504 corners 504C), and in fact, not every generally hexagonal ridge 504 corner 504C around a single cell 252 needs to have a raised secondary traction element structure. One or more of the ridge components 504 of a given cell 252 may have a generally straight line structure along the ground-facing surface 248G and/or optionally a linear or curved structure that moves closer to the upper-facing surface 248U moving from one corner 504C to an adjacent corner 504C. In this manner, secondary traction elements may be placed at desired locations around the ground-engaging element 240 structure and left out (e.g., with smooth corners 504C and/or edges in the z-direction) at other desired locations. Additionally or alternatively, if desired, raised points and/or other secondary traction elements could be provided at other locations on the matrix structure 250, e.g., anywhere along ridge 504 or between adjacent cells or partial cells.

Notably, in this example construction, the matrix structure 250 defines the cells 252 (and 252J) such that the perimeter of the entrance to the cell opening 252 around the upper-facing surface 248U (e.g., defined by perimeter 244P of the ovoid shaped opening) is smaller than the perimeter of the entrance to the cell opening 252 around the ground-facing surface 248G (e.g., defined by the generally hexagonal perimeter ridge 504). Stated another way, the area of the entrance to the cell opening 252 from the upper-facing surface 248U (e.g., the area within the perimeter 244P of the ovoid shaped opening) is smaller than the area of the entrance to the cell opening 252 from the ground-facing surface 248G (e.g., the area within the generally hexagonal perimeter ridge 504). The generally hexagonal perimeter ridge 504 completely surrounds the perimeter 244P in at least some cells. This difference in the entrance areas is due to the sloped/curved sides walls 506 from the upper-facing surface 248U to the ground-facing surface 248G.

FIGS. 5F through 5H show views similar to those in FIGS. 5A, 5B, and 5E but with a portion of the matrix structure 250 originating in the inner perimeter boundary rim 242I or outer perimeter boundary rim 242O (and thus showing a partially open cell 254). As shown in FIG. 5G, in this illustrated example, the matrix structure 250 morphs outward and downward from the ground-facing surface 248G of the perimeter boundary rim member 242I, 242O. A "partial cell" in this structure is shown, for example, at the top of FIG. 5G (i.e., partial cell 252J that shares a side wall 506 with the partially open cell 254 and is defined by the parts of the matrix structure 250 that originate in or "morph outward" from boundary rim(s) 242I/242O)). This type of "morphed" construction may be accomplished, for example, by molding the matrix structure 250 as an unitary, one-piece component with one or both of the perimeter boundary rim member(s) 242I, 242O. Alternatively, the matrix structure 250 could be formed as a separate component that is fixed to the perimeter boundary rim member(s) 242I, 242O, e.g., by cements or adhesives, by mechanical connectors, etc. As another option, the matrix structure 250 may be made as an unitary, one-piece component with one or both of the perimeter boundary rim members 242I, 242O by rapid manufacturing techniques, including rapid manufacturing additive fabrication techniques (e.g., 3D printing, laser sintering, etc.) or rapid manufacturing subtractive fabrication techniques (e.g., laser ablation, etc.). The structures and various parts shown in FIGS. 5F-5H may have any one or more of the various characteristics, options, and/or features of the similar structures and parts shown in FIGS. 5A-5E (and like reference numbers in these figures represent the same or similar parts to those used in other figures).

II. CONCLUSION

The present invention is disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

For the avoidance of doubt, the present application includes the subject-matter described in the following numbered paragraphs (referred to as "para." or "paras."):

[Para. 1] A ground-engaging component for an article of footwear, comprising:

an outer perimeter boundary rim that at least partially defines an outer perimeter of the ground-engaging component;

an inner perimeter boundary rim that at least partially defines an inner perimeter of the ground-engaging component, wherein a first open space is defined between the outer perimeter boundary rim and the inner perimeter boundary rim, and wherein a second open space is defined between a lateral side portion of the inner perimeter boundary rim and a medial side portion of the inner perimeter boundary rim; and a support structure extending from the outer perimeter boundary rim to the inner perimeter boundary rim and at least partially across the first open space.

[Para. 2] The ground-engaging component according to Para. 1, wherein the outer perimeter boundary rim and the inner perimeter boundary rim are formed as an unitary, one piece construction.

[Para. 3] The ground-engaging component according to Para. 1 or Para. 2, wherein the outer perimeter boundary rim and the inner perimeter boundary rim form a U-shaped component that includes at least a lateral side forefoot support area, a front forefoot support area, and a medial side forefoot support area.

[Para. 4] The ground-engaging component according to Para. 1 or Para. 2, wherein the outer perimeter boundary rim is connected with the inner perimeter boundary rim at a first free end boundary rim located at one of a lateral side forefoot support area or a lateral side midfoot support area; and wherein the outer perimeter boundary rim is connected with the inner perimeter boundary rim at a second free end boundary rim located at one of a medial side forefoot support area or a medial side midfoot support area.

[Para. 5] The ground-engaging component according to Para. 4, wherein the second free end boundary rim is located closer to a front forefoot support area of the ground-engaging component than is the first free end boundary rim.

[Para. 6] The ground-engaging component according to any preceding Para., wherein an outside edge of the outer perimeter boundary rim and an inside edge of the inner perimeter boundary rim are separated from one another across the first open space by a direct distance of no more than 1.75 inches (44.5 mm) around at least 60% of the outer perimeter of the ground-engaging component.

[Para. 7] The ground-engaging component according to any preceding Para., wherein an outside edge of the outer perimeter boundary rim and an inside edge of the inner perimeter boundary rim are separated from one another across the first open space by a direct distance of no more than 1.5 inches (38.1 mm) around at least 80% of the outer perimeter of the ground-engaging component.

[Para. 8] The ground-engaging component according to any preceding Para., wherein an outside edge of the outer perimeter boundary rim and an inside edge of the inner perimeter boundary rim are separated from one another across the first open space by a direct distance of no more than 1.5 inches (38.1 mm) around the outer perimeter of the ground-engaging component.

[Para. 9] The ground-engaging component according to any preceding Para., wherein the outer perimeter boundary rim and the inner perimeter boundary rim define an upper-facing surface and a ground-facing surface opposite the upper-facing surface, and wherein the support structure includes a matrix structure extending across the first open space to define a cellular construction, wherein the matrix structure defines at least one of: (a) one or more open cells located within the first open space or (b) one or more partially open cells located within the first open space.

[Para. 10] The ground-engaging component according to Para. 9, wherein the matrix structure further defines a first cleat support area extending between the outer perimeter boundary rim and the inner perimeter boundary rim and across the first open space.

[Para. 11] The ground-engaging component according to Para. 10, further comprising:

a track spike engaged at the first cleat support area.

[Para. 12] The ground-engaging component according to Para. 10 or Para. 11, wherein the matrix structure further defines a plurality of secondary traction elements dispersed around the first cleat support area.

[Para. 13] The ground-engaging component according to Para. 9, wherein the matrix structure further defines:

a first cleat support area at or near a lateral forefoot support area or a lateral midfoot support area of the ground-engaging component;

a second cleat support area at the lateral forefoot support area and forward of the first cleat support area;

a third cleat support area at or near a medial forefoot support area or a medial midfoot support area of the ground-engaging component; and a fourth cleat support area at the medial side forefoot support area and forward of the third cleat support area.

[Para. 14] The ground-engaging component according to Para. 13, further comprising a first track spike engaged at the first cleat support area, a second track spike engaged at the second cleat support area, a third track spike engaged at the third cleat support area, and a fourth track spike engaged at the fourth cleat support area.

[Para. 15] The ground-engaging component according to any preceding Para., wherein the outer perimeter boundary rim, the inner perimeter boundary rim, and the support structure extending across the first open space constitute an unitary, one piece construction.

[Para. 16] The ground-engaging component according to any preceding Para., wherein the outer perimeter boundary rim, the inner perimeter boundary rim, and the support structure extending across the first open space have a combined mass of less than 20 grams.

[Para. 17] The ground-engaging component according to any preceding Para., wherein the outer perimeter boundary rim is at least 3 mm (0.12 inches) wide.

[Para. 18] The ground-engaging component according to any preceding Para., wherein the outer perimeter boundary rim is present around at least 80% of the outer perimeter of the ground-engaging component.

[Para. 19] The ground-engaging component according to any preceding Para., wherein the inner perimeter boundary rim is at least 3 mm (0.12 inches) wide.

[Para. 20] The ground-engaging component according to any preceding Para., wherein the inner perimeter boundary rim is present around at least 80% of the outer perimeter of the ground-engaging component.

[Para. 21] An article of footwear, comprising:

an upper; and a sole structure engaged with the upper, the sole structure including a ground-engaging component according to any preceding Para.

[Para. 22] The article of footwear according to Para. 21, wherein at least a portion of the upper includes a woven textile component.

[Para. 23] The article of footwear according to Para. 21, wherein at least a portion of the upper includes a knitted textile component.

[Para. 24] The article of footwear according to any one of Paras. 21 through 23, wherein the sole structure further includes a midsole component positioned between the ground-engaging component and a bottom of the upper.

[Para. 25] The article of footwear according to Para. 24, wherein the midsole component includes a foam midsole element.

[Para. 26] The article of footwear according to Para. 24 or Para. 25, wherein a bottom surface of the midsole component is exposed at an exterior of the sole structure in the second open space.

[Para. 27] The article of footwear according to Para. 26, wherein the bottom surface of the midsole component is exposed at the exterior of the sole structure and extends from the second open space to a rear heel support area of the sole structure.

[Para. 28] The article of footwear according to any one of Paras. 21 through 27, wherein the sole structure further includes a heel reinforcement component located at least at a lateral, rear heel support area of the sole structure.

[Para. 29] The article of footwear according to any one of Paras. 21 through 27, wherein the sole structure further includes a heel reinforcement component located at a lateral, rear heel support area of the sole structure, wherein the heel reinforcement component terminates before reaching a medial heel side of the sole structure.

[Para. 30] The article of footwear according to Para. 28 or Para. 29, wherein the heel reinforcement component includes a matrix structure with a plurality of open cells.

[Para. 31] The article of footwear according to Para. 28, Para. 29, or Para. 30, wherein the heel reinforcement component includes ground-engaging traction elements.

What is claimed is:

1. A ground-engaging component for an article of footwear, comprising:

an outer perimeter boundary rim that at least partially defines an outer perimeter of the ground-engaging component;

an inner perimeter boundary rim that at least partially defines an inner perimeter of the ground-engaging component, wherein a first open space extending completely through the ground-engaging component is defined between the outer perimeter boundary rim and the inner perimeter boundary rim, and wherein a second open space is defined between a lateral side portion of the inner perimeter boundary rim and a medial side portion of the inner perimeter boundary rim; and a support structure extending from the outer perimeter boundary rim to the inner perimeter boundary rim and across the first open space, wherein the support structure defines plural openings within the first open space that extend completely through the ground-engaging component.

2. The ground-engaging component according to claim 1, wherein the outer perimeter boundary rim and the inner perimeter boundary rim are formed as an unitary, one piece construction.

3. The ground-engaging component according to claim 1, wherein the outer perimeter boundary rim and the inner perimeter boundary rim form a U-shaped component that includes at least a lateral side forefoot support area, a front forefoot support area, and a medial side forefoot support area.

4. The ground-engaging component according to claim 1, wherein the outer perimeter boundary rim is connected with the inner perimeter boundary rim at a first free end boundary rim located at one of a lateral side forefoot support area or a lateral side midfoot support area; and wherein the outer perimeter boundary rim is connected with the inner perimeter boundary rim at a second free end boundary rim located at one of a medial side forefoot support area or a medial side midfoot support area.

5. The ground-engaging component according to claim 4, wherein the second free end boundary rim is located closer to a front forefoot support area of the ground-engaging component than is the first free end boundary rim.

6. The ground-engaging component according to claim 1, wherein an outside edge of the outer perimeter boundary rim and an inside edge of the inner perimeter boundary rim are separated from one another across the first open space by a direct distance of no more than 1.5 inches (38.1 mm) around at least 80% of the outer perimeter of the ground-engaging component.

7. The ground-engaging component according to claim 1, wherein the outer perimeter boundary rim and the inner perimeter boundary rim define an upper-facing surface and a ground-facing surface opposite the upper-facing surface, wherein the support structure includes a matrix structure extending across the first open space to define a cellular construction, and wherein the plural openings of the support structure define at least one of: (a) plural open cells of the cellular construction located within the first open space or (b) plural partially open cells of the cellular construction located within the first open space.

8. The ground-engaging component according to claim 7, wherein the matrix structure further defines a first cleat support area extending between the outer perimeter boundary rim and the inner perimeter boundary rim and across the first open space.

9. The ground-engaging component according to claim 8, wherein the matrix structure further defines a plurality of secondary traction elements dispersed around the first cleat support area.

10. The ground-engaging component according to claim 7, wherein the matrix structure further defines:

a first cleat support area at or near a lateral forefoot support area or a lateral midfoot support area of the ground-engaging component;

a second cleat support area at the lateral forefoot support area and forward of the first cleat support area;

a third cleat support area at or near a medial forefoot support area or a medial midfoot support area of the ground-engaging component; and a fourth cleat support area at the medial side forefoot support area and forward of the third cleat support area.

11. The ground-engaging component according to claim 1, wherein the outer perimeter boundary rim, the inner perimeter boundary rim, and the support structure extending across the first open space constitute an unitary, one piece construction.

12. The ground-engaging component according to claim 1, wherein the outer perimeter boundary rim, the inner perimeter boundary rim, and the support structure extending across the first open space have a combined mass of less than 20 grams.

13. The ground-engaging component according to claim 1, wherein the inner perimeter boundary rim is at least 3 mm (0.12 inches) wide and wherein the outer perimeter boundary rim is at least 3 mm (0.12 inches) wide.

14. An article of footwear, comprising:

an upper; and a sole structure engaged with the upper, the sole structure including a ground-engaging component that includes:

an outer perimeter boundary rim that at least partially defines an outer perimeter of the ground-engaging component;

an inner perimeter boundary rim that at least partially defines an inner perimeter of the ground-engaging component, wherein a first open space extending completely through the ground-engaging component is defined between the outer perimeter boundary rim and the inner perimeter boundary rim, and wherein a second open space is defined between a lateral side portion of the inner perimeter boundary rim and a medial side portion of the inner perimeter boundary rim; and a support structure extending from the outer perimeter boundary rim to the inner perimeter boundary rim and across the first open space wherein the support structure defines plural openings within the first open space that extend completely through the ground-engaging component.

15. The article of footwear according to claim 14, wherein at least a portion of the upper includes a knitted textile component or a woven textile component.

16. The article of footwear according to claim 14, wherein the sole structure further includes a midsole component positioned between the ground-engaging component and a bottom of the upper.

17. The article of footwear according to claim 16, wherein a bottom surface of the midsole component is exposed at an exterior of the sole structure through the plural openings of the support structure in the first open space.

18. The article of footwear according to claim 17, wherein the bottom surface of the midsole component is exposed at the exterior of the sole structure and extends from the second open space to a rear heel support area of the sole structure.

19. The article of footwear according to claim 14, wherein the sole structure further includes a heel reinforcement component located at least at a lateral, rear heel support area of the sole structure.

20. The article of footwear according to claim 19, wherein the heel reinforcement component includes a matrix structure with a plurality of open cells.

* * * * *